United States Patent [19]

Johnson

[11] 4,184,668

[45] Jan. 22, 1980

[54] ADJUSTABLE QUICK ACTING VISE

[76] Inventor: June A. Johnson, 77 S. Avery, Pontiac, Mich. 48056

[21] Appl. No.: 925,231

[22] Filed: Jul. 17, 1978

[51] Int. Cl.[2] ..... B25B 1/14

[52] U.S. Cl. ..... 269/211; 269/228

[58] Field of Search ..... 269/211, 228, 99–101, 269/282

[56] References Cited

U.S. PATENT DOCUMENTS

| | | | |
|---|---|---|---|
| 380,461 | 4/1888 | Smith et al. | 269/211 |
| 2,340,330 | 2/1944 | Kipper | 269/228 |
| 2,379,107 | 6/1945 | Scheck | 269/228 |

*Primary Examiner*—Robert C. Watson

*Attorney, Agent, or Firm*—Basile and Weintraub

[57] ABSTRACT

An adjustable quick acting vise having a toggle action lever acting upon a pair of spaced apart rails. The rails have a multiplicity of pairs of grooves for engaging a cross pin which is moveable by the toggle action. The multiplicity of pairs of grooves produces a multiplicity of vise openings for holding work pieces of varying width. The rails are removable in the preferred embodiment to allow the substitution of a pair of rails with greater or shorter length further increasing the flexability of the vise.

4 Claims, 4 Drawing Figures

ADJUSTABLE QUICK ACTING VISE

BACKGROUND OF THE INVENTION

I. Field of the Invention

The present invention relates to the field of vises having a quick acting clamping action, and particularly to quick acting vises having a jaw adjustable for width and readily replaceable with a substitute rail and jaw.

II. Description of the Prior Art

The prior art which the Inventor has been able to discover consists of the following U.S. Pat. Nos. 960,415; 2,699,698; 2,925,109; 3,688,765; 3,752,466; 3,815,894 and 3,628,783. The above patents disclose, generally, a variety of quick acting vises for use on a bench. U.S. Pat. Nos. 2,699,698 and 3,628,783 come the closest to the present invention in that they teach the use of a toggle action lever acting on a horizontally moveable rod for inducing the clamping action. None of the above cited patents teach the use of a replaceable and adjustable pair of spaced apart longitudinal rails joined at their ends and having a toggle action lever disposed therebetween for imparting a horizontal clamping action.

SUMMARY OF THE INVENTION

An object of the present invention is to provide a quick acting vise which is highly effective for clamping work on a work bench using a toggle action lever.

The toggle action lever is disposed between a pair of spaced apart longitudinal rails joined at their ends. The lever toggles a drive pin longitudinally. A cross pin threadingly attached to one end of the drive pin engages a multiplicity of pairs of short grooves disposed along the pair of longitudinal rails. Each pair of short grooves communicates with an adjacent pair of long grooves starting near the first end and ending spaced from the second end of the pair of spaced apart longitudinal rails. The pair of long grooves permits the cross pin to be moved from one pair of slots to another along the length of the long grooves. This vise provides thereby an easy and reliable way to change the vise opening to accommodate different sized objects while protecting the toggle shafts from bending.

These and other objects of this invention will more fully appear from the following description made in connection with the accompanying drawings wherein like reference numbers refer to like parts throughout the several views.

DESCRIPTION OF THE PREFERRED EMBODIMENT

Figure 1:
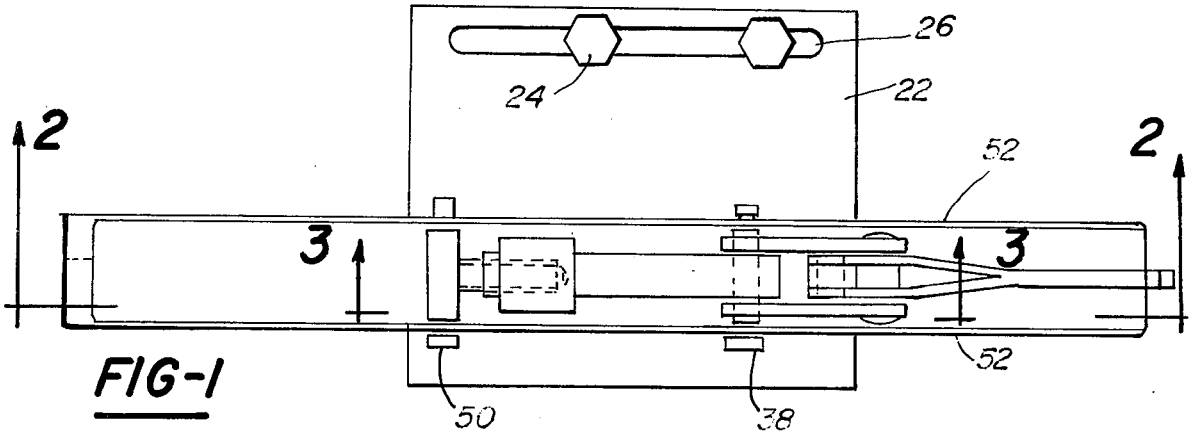
FIG. 1 is a plan view of the novel device.
Figure 2:
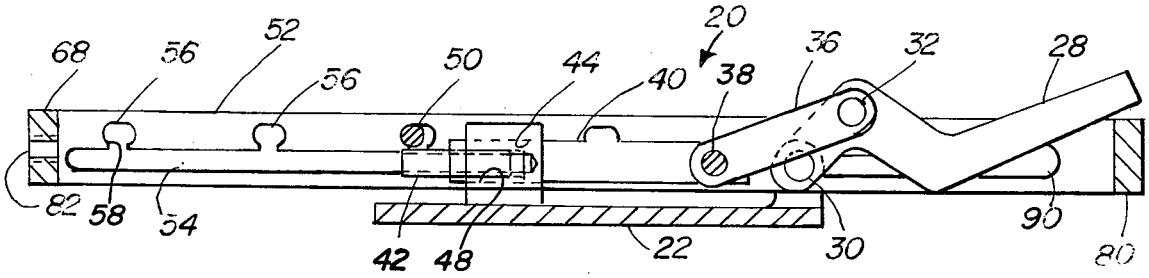
FIG. 2 is a cross-sectional view taken along a plane 2—2 in FIG. 1.
Figure 3:
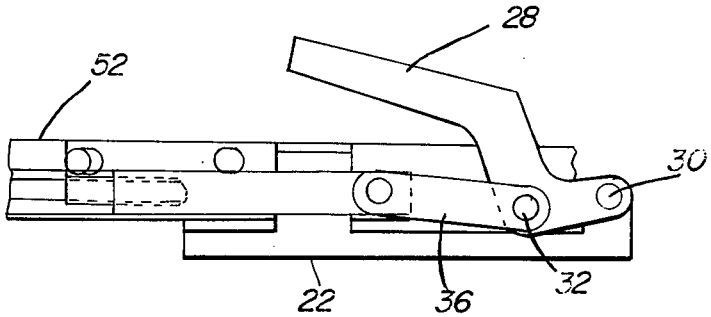
FIG. 3 is a partial repeat of FIG. 2 showing the toggle motion.
Figure 4:
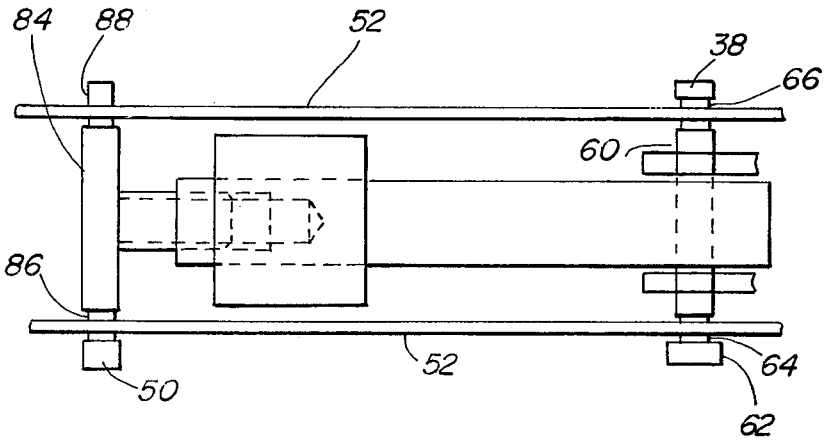
FIG. 4 is an enlarged top view of a portion of the vise showing the cross pin and the drive pin in the preferred embodiment.

Referring now to the drawings and more specifically to FIG. 2 wherein there is shown one embodiment of this novel quick acting vise, generally depicted at 20 comprising a base 22 attached to a work bench or the like by a pair of threaded fasteners 24 projecting through a slot 26 in the base 22. The slot 26 allows longitudinal adjustment of the base by moving the position of the base along slot 26.

A lever 28 is pivotally attached to the base 22 at a pivot point 30. A pivot pin 32 is spaced above pivot point 30 and is pivotally supported by a hole through lever 28. A pair of links 36 are disposed on either side of the lever 28. One end of the links 36 is pivotally supported by pivot pin 32, the other end of links 36 is pivotally supported by a drive pin 38. Pivot pin 32 retains the pair of links 36 permenantly in place by means of rivetted or enlarged ends, or snap fasteners, or the like.

Drive pin 38 is slidingly supported by a transverse bore near the second end of a drive rod 40. The drive rod 40 is axially aligned and slidingly supported by a support bore 44 in the base 22. The first end of the drive rod 40 contains an axial threaded bore 48. A threaded rod 42 threadingly engages the threaded bore 48. The outer end of the threaded rod 42 has a cross pin 50 fixedly and transversely attached thereto.

A pair of spaced apart rails 52 are disposed on either side of the lever 28. A pair of long grooves 54 run the length of each spaced apart rail 52. A multiplicity of pairs of short grooves 56 are spaced above the long grooves 54 and are connected to the long grooves by means of a multiplicity of channels 58. Cross pin 50 projects through the spaced apart longitudinal rails and is slidingly moveable at a undercut 86 and a reduced diameter 88 along long groove 54 and into the channels 58 and in the short grooves 56 supporting the spaced apart longitudinal rails thereby. The drive pin 38 is slidingly moveable at its undercut diameters 64 and 66 in the long grooves 54, projecting through the spaced apart longitudinal rails 52 and supporting the rails thereby.

When the cross pin 50 is disposed in a pair of short grooves 56, the longitudinal toggle action generated by the lever 28 is transmitted to the pair of spaced apart longitudinal rails 52. By moving the cross pin 50 from one pair of short grooves 56 to another, the opening of the vise 20 can be varied by the spacing of the short grooves 56.

A first end 68 joining the spaced apart longitudinal rails has a threaded aperture 82 therein which is used to attach a variety of jaw configurations which are threadingly engaged thereto. The threads are useable to finely adjust the spacing of the jaw opening.

The drive pin 38 has a diameter greater than the width of the long grooves 54 and it has at one end an enlarged head 62. Abutting the inside end of the enlarged head and near the other end is a pair of undercuts 64 and 66. The width, diameter, and spacing of the undercuts allows the drive pin 38 to move freely along grooves 54 and 56.

The cross pin 50 has a diameter 84 larger than the width of the long grooves 54 and it has spaced in from one end an undercut 86 equal in diameter and width to the undercuts 64 and 66 on drive pin 38. At the other end of the cross pin is a reduced diameter 88 the diameter of which equals the diameter of undercut 86. The width of undercut 86 and the spacing therefrom of reduced diameter 88 allows the cross pin to move freely in the pair of longitudinal grooves 54. Cross pin 50 is longer than the spacing between the spaced apart longitudinal rails 52 to provide support thereof. Reduced diameter 88 runs from its shoulder to the other end of the cross pin 38.

The end of the pair of long grooves spaced apart from the other end 80 of the pair of spaced apart longitudinal rails terminates at a pair of enlarged apertures 90. The diameter of apertures 90 slidingly clears the outside diameter 60 of the drive pin 38 and the outside diameter 84 of the cross pin 50. To remove the pair of spaced apart longitudinal rails 52 and replace them with another pair of different length, drive pin 38 is moved in line with aperture 90 and then drive pin 38 is easily removed. The drive rod 40 is removed then from longitudinal bore 44. The spaced apart longitudinal rails are then spread to release the cross pin 50. A reverse order of assembly is used to assemble another pair of spaced apart longitudinal rails.

Having thus described the preferred embodiment of my invention, other uses and embodiments of the present invention will become obvious to those skilled in the art of quick acting vises.

What I claim is:

1. An adjustable quick acting vise comprising:

a base fixed to a work surface;

a pair of spaced apart longitudinal rails having first and second ends attached thereto;

a lever positioned between said rails and pivotally attached at one end to said base at a pivot point;

a pivot pin pivotally attached to said lever at a position spaced above said pivot point;

a pair of links spaced on either side of said lever and attached at one end to said pivot pin and at the other end to a drive pin;

said drive pin is slidingly connected to a first end of a drive rod, said drive rod is slidingly supported longitudinally by a support bore in said base, the combined action of said lever, said pair of links, said pivot pin, said drive pin and said drive rod constituting a longitudinal toggle action on said drive rod when said lever is actuated;

a threaded rod threadingly supported at the second end of said drive rod by a threaded bore;

a cross pin running perpendicular to said threaded rod and fixedly attached to the outer end of said threaded rod, spaced above the center of said rod;

said pair of spaced apart longitudinal rails having each a long groove, said long groove beginning near said first end and ending spaced apart from said second end of said spaced apart longitudinal rails the width of said long groove is slidingly larger than the diameter of said drive pin and said cross pin; a multiplicity of pairs of short grooves, said short grooves equal in width to the width of said long grooves, their length being twice their width with round ends, each short groove is joined to its adjacent long groove by a channel, said channel having a width equal to the width of said grooves;

the length of said drive pin and said cross pin exceeding the spacing of said spaced longitudinal rails.

2. An adjustable quick acting vise as defined in claim 1 wherein said first end joining said pair of spaced longitudinal rails has a threaded aperture at its center, the axis of said threaded aperture running parallel to the axis of said drive rod, said threaded aperture accommodating adjustable vise jaws.

3. An adjustable quick acting vise as defined in claim 1 wherein:

said drive pin has a diameter larger than the width of said grooves, an enlarged head at one end, a first undercut diameter adjacent to said enlarged head, a second undercut diameter spaced from the other end of said drive pin, said undercuts slidingly moveable in said grooves and spaced apart a distance equal to the spacing of said pair of spaced longitudinal rails, the width of said undercuts slightly larger than the thickness of said longitudinal rails;

said cross pin having a diameter equal to the diameter of said drive pin an undercut spaced from one end, a reduced diameter for a distance at the other end, said cross pin undercut and said reduced diameter having a diameter equal to the diameter of said undercuts, the width of said cross pin undercut equalling the width of said undercuts, the spacing of said cross pin undercut and said reduced diameter being the same as the spacing of said grooves;

the second end of said long grooves ending in an aperture to slidingly engage said drive pin diameter.

4. An adjustable quick acting vise as defined in claim 3 further comprising:

said base having an elongated slot, said slot running parallel to and spaced apart from said drive rod.

* * * * *